United States Patent [19]

Ishida et al.

[11] Patent Number: 5,007,160

[45] Date of Patent: Apr. 16, 1991

[54] APPARATUS FOR PRESS-INSTALLING WIRES

[75] Inventors: Masahiko Ishida, Kosai; Nobuaki Yamakawa; Masahiro Shiida, both of Shizouka, Japan

[73] Assignee: Yazaki Corporation, Tokyo, Japan

[21] Appl. No.: 378,673

[22] Filed: Jul. 12, 1989

[30] Foreign Application Priority Data

Jul. 14, 1988 [JP] Japan ..... 63-173693

[51] Int. Cl.[5] ..... H01R 43/04

[52] U.S. Cl. ..... 29/753; 29/721

[58] Field of Search ..... 29/721, 720, 753, 749, 29/755, 759

[56] References Cited

U.S. PATENT DOCUMENTS

| | | | |
|---|---|---|---|
| 3,377,915 | 4/1968 | Buckett | 29/741 X |
| 3,548,493 | 12/1970 | Hubbard | 29/721 X |
| 3,866,297 | 2/1975 | Aldridge et al. | 29/753 X |
| 4,091,531 | 5/1978 | Grubb et al. | 29/753 X |
| 4,238,874 | 12/1980 | Chandler et al. | 29/753 X |

*Primary Examiner*—Carl E. Hall

*Attorney, Agent, or Firm*—Armstrong, Nikaido, Marmelstein, Kubovcik & Murray

[57] ABSTRACT

A wire press-installing apparatus having a ram which is lowered onto the joint block to press wires into rows of receiver terminals that are erected at a specified pitches on the joint block of a wiring harness. The joint block is intermittently fed by a distance equal to the pitch of the terminal rows and only the predetermined wires are selectively taken out and seated into the associated rows of receiver terminals. This prevents wrong wires from being seated in unintended terminals or the joint block from being fed by a wrong pitch. The apparatus has a wire misinstallation detection mechanism which includes wire guides mounted vertically slidable on the lower front and back side of the vertically movable wire press-installing blade through a resilient member. When a wire is misinstalled, the lower ends of the wire guides abut against a misinstalled wire that has fallen from the receiver terminals onto the joint block; thereby causing the wire guides to move up, activating an alarm circuit and then stopping the lowering movement of the ram. This eliminates defective products and significantly improves work efficiency.

1 Claim, 5 Drawing Sheets

APPARATUS FOR PRESS-INSTALLING WIRES

BACKGROUND OF THE INVENTION

1. Field of the Invention

This invention relates to an apparatus for press-installing wires into receiver terminals on a joint block used in wiring the electric circuits in automobiles and also to a method of selecting wires to be press-installed on the joint block.

2. Description of the Prior Art

The joint block is designed to simplify wiring configurations by collectively forming the joints of a wiring harness in one block. A general construction of the joint block is shown in FIG. 6.

A plurality of rows of receiver terminals 3 are inserted through a base 2 of the joint block 1 at specified pitches P, and wires W are pressed into slots 4 in the terminals 3. The wire installation in the terminals 3 is done by manually operating the wire press-installing apparatus. That is, a ram attached with a wire press-installing blade is vertically moved to push one wire W into a row of receiver terminals 3 at one time. The wires used are rated wires that are classified by the conductor diameters, color of insulations, presence or absence of stripes marked on insulations, and the number of stripes, these parameters varying according to the dimensions of receiver terminals 3 and the wiring routes of the wiring harness. Wire seating is successively performed beginning with the terminal row $A_1$ at one end of the joint block toward the terminal row $A_n$ at the other end. Each of the terminal rows is assigned a predetermined kind of wires (these kinds of wires may or may not be the same).

At each end of the joint block 1, there are formed a recess 5 and a plurality of wire positioning grooves 6, the recess 5 being adapted to prevent the seated wires W from being pulled out in lateral directions, the wire positioning grooves 6 being located corresponding to multiple rows of terminals $A_1, A_2, \ldots, A_n$. A cover 7 with projections 8 is placed on the joint block 1 so as to clamp the seated wires W between the recesses 5 and the projections 8.

In the conventional wire press-installing work, an operator feeds the joint block one pitch at a time, with the wire press-installing blade facing the joint block. This method has the following drawbacks. That is, the work efficiency is low and there is a possibility that the operator may inadvertently skip terminal rows without seating wires on them. In addition, erroneous wiring may occur in which wrong wires are seated in unintended terminal rows.

SUMMARY OF THE INVENTION

The object of this invention is to provide a wire press-installing apparatus and a method of selecting wires to be press-installed, which overcome the above-mentioned drawbacks and which, by making the wire seating process semiautomatic, improves the work efficiency, prevents manufacture of faulty products by detecting misinstallation of wires, and assures correct selection of specified rated wires for respective rows of terminals on the joint block, thus effecting correct wire jointing.

The above objective can be achieved by a wire press-installing apparatus for securely seating wires into multiple rows of receiver terminals erected at specified pitches on a base of the joint block, which comprises: a receiver block for securely holding the joint block thereon; a table on which the receiver block is so mounted that it can be moved intermittently by a distance equal to the pitch of the receiver terminals on the joint block; a ram disposed above the table and opposed to the receiver block, the ram being able to be vertically moved toward and away from the receiver block, the ram having a wire press-installing blade at the lower end thereof; and wire axis aligning jigs mounted on the table for temporarily holding the wire in such a manner that the wire faces a row of receiver terminals arranged on the base of the joint block.

Manufacture of faulty products can be prevented by detecting misinstallation of wires, and this is achieved by a wire press-installing apparatus which comprises: wire guides mounted vertically slidable on the lower front and back side of the vertically movable wire press-installing blade through a resilient member, the wire guides being formed at their lower ends with guide surfaces; and a mechanism for detecting wire misinstallation, the wire misinstallation detection mechanism being adapted to close an electric contact for activating an alarm circuit when the lower ends of the guide surfaces of the wire guides abut against a misinstalled wire, which has fallen from the receiver terminals onto the base of the joint block, and the wire guides move up against the resistance of the resilient member.

Furthermore, in successively seating the specified wires into corresponding rows of receiver terminals starting from the row at one end of the joint block toward the row at the other end, an operator can correctly select and pick up wires for respective terminal rows that are spaced at specified pitches, according to the following method. A wire selection method comprises the steps of: selecting one of wire containers according to the order of press-installing the specified rated wires, the containers containing the same or different kinds of rated wires to be seated in respective rows of receiver terminals, the containers each having a cover attached to one end thereof, the cover being able to be opened and closed; and opening the cover attached to one end of the selected wire container so that a wire contained therein can be picked up.

Now, the above construction of the apparatus according to the invention will be described by referring to the attached drawings that show one embodiment.

DESCRIPTION OF THE PREFERRED EMBODIMENT

Figure 1:
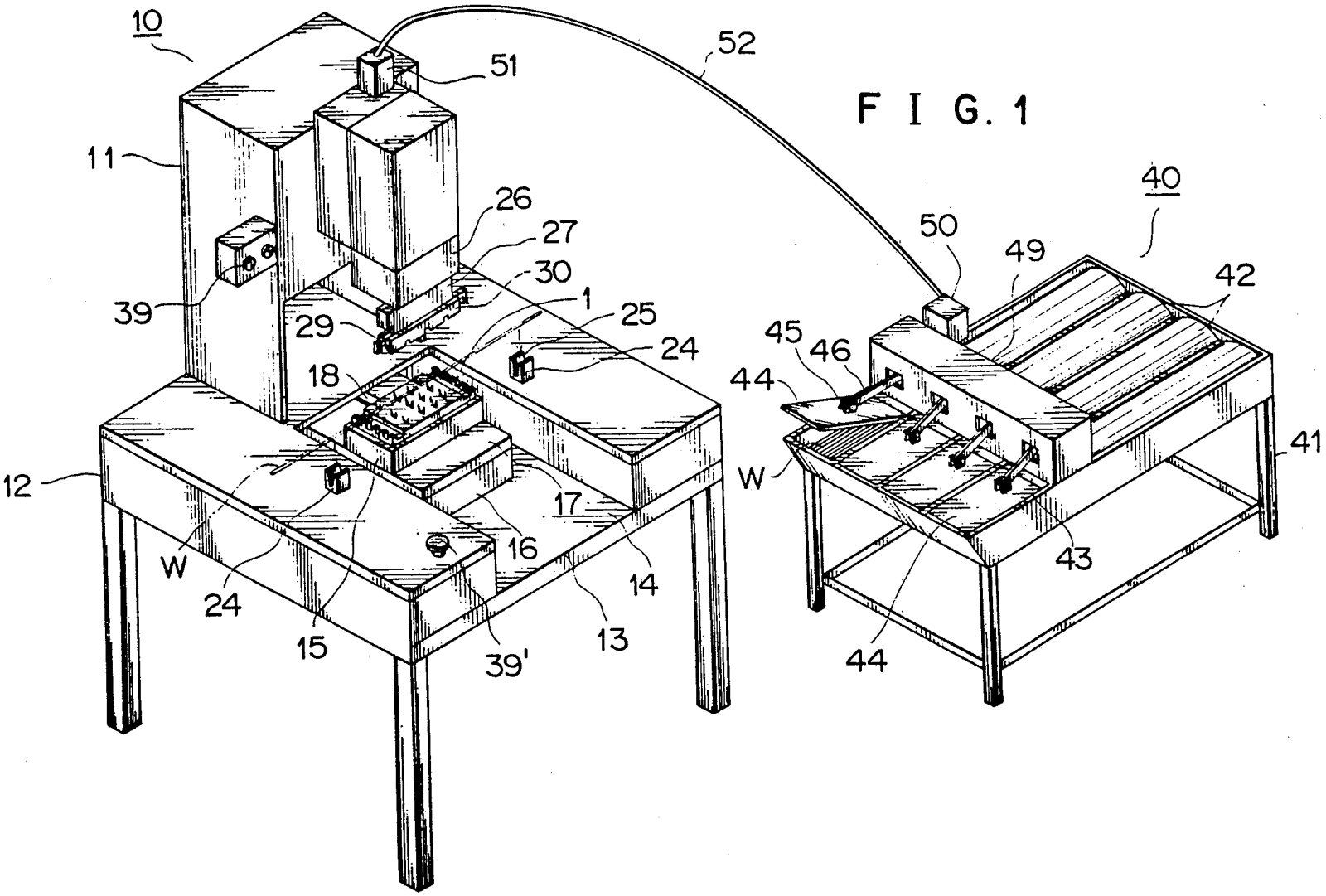
FIG. 1 is a perspective view showing the outline of one embodiment of this invention.
Figure 2:
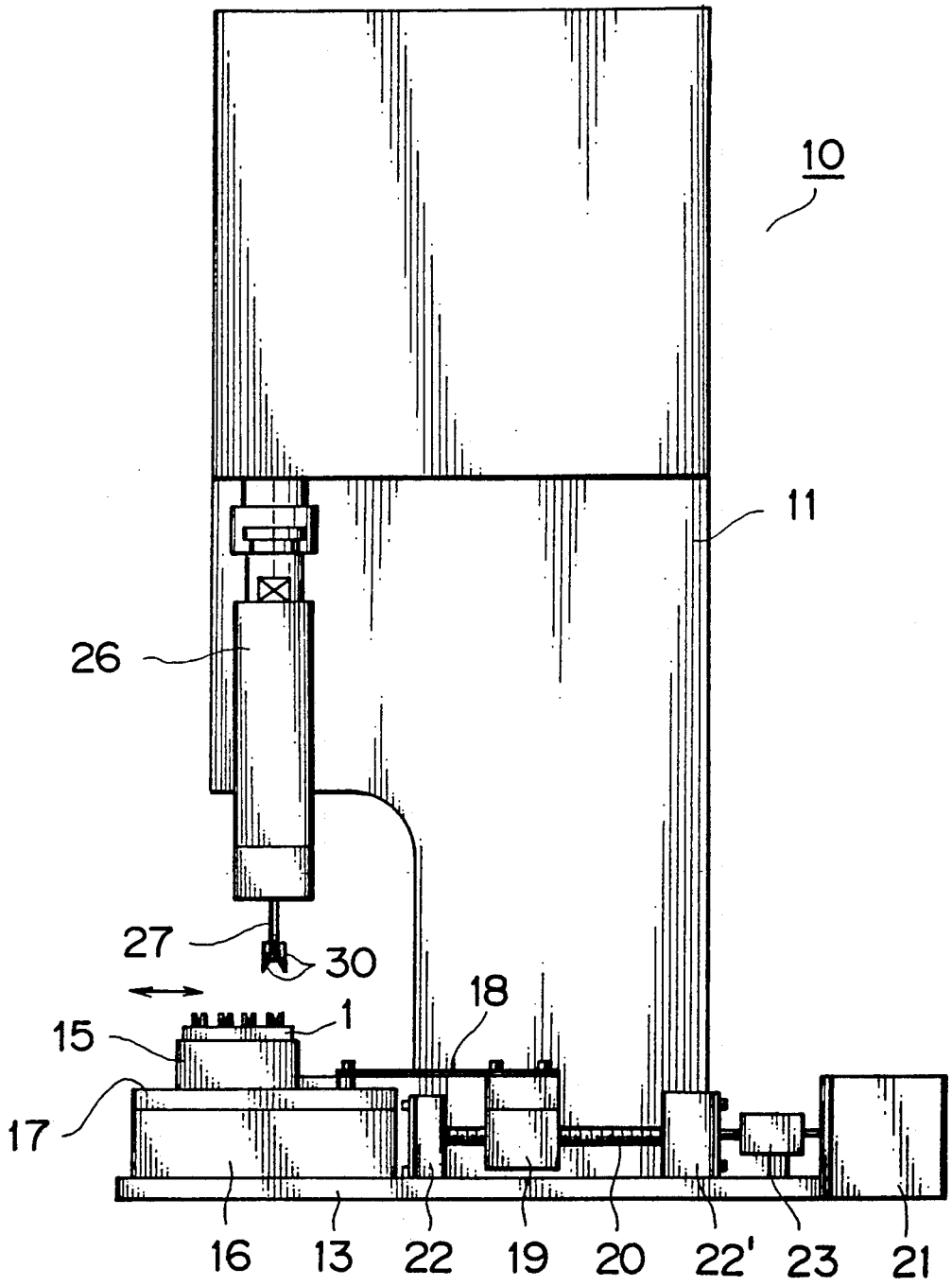
FIG. 2 is an expanded side view of a wire press-installing portion of the apparatus.
Figure 4:
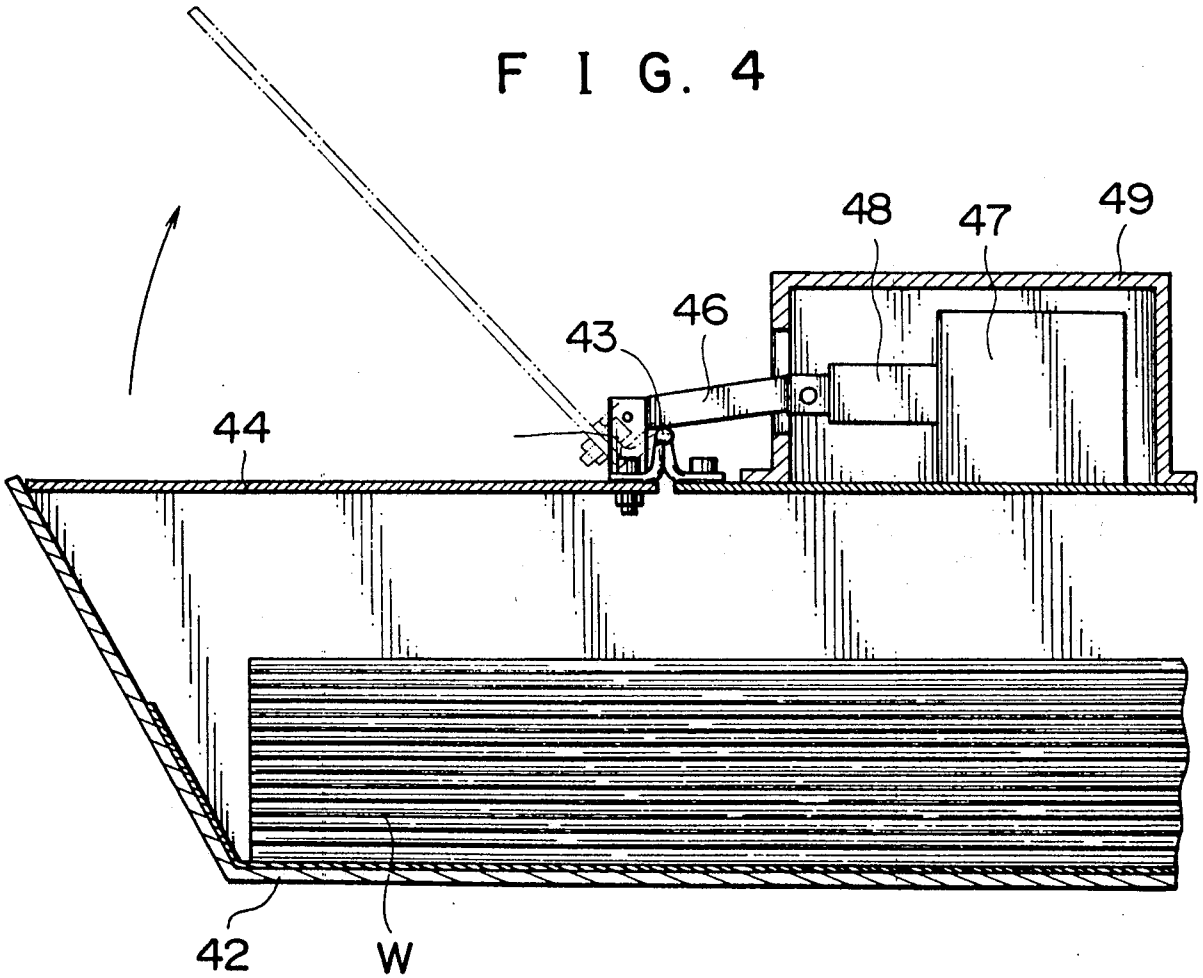
FIG. 4 is an expanded cross-sectional view of an essential portion of a wire storage device.
Figure 3:
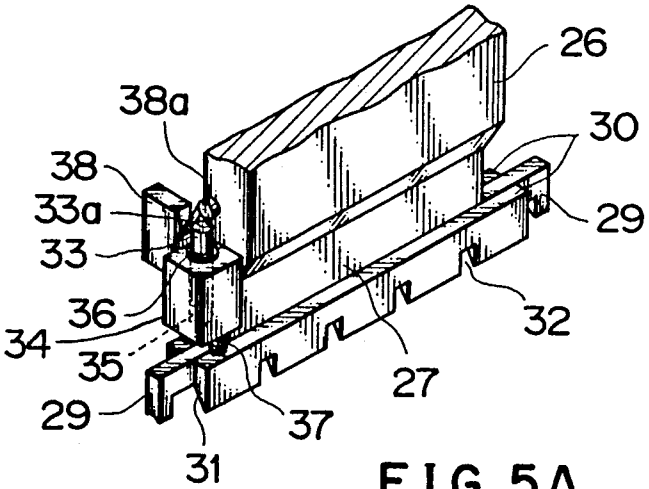
FIG. 3 is an expanded perspective view of a wire press-installing blade of the apparatus.
Figure 5A:
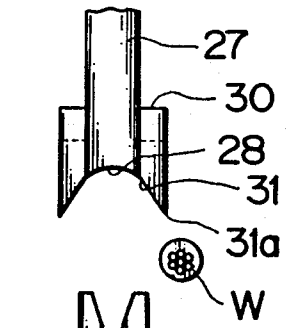
FIGS. 5A to 5C are schematic side views showing the process of press-installing wires and also a mechanism for detecting a misinstalled wire.
Figure 5B:
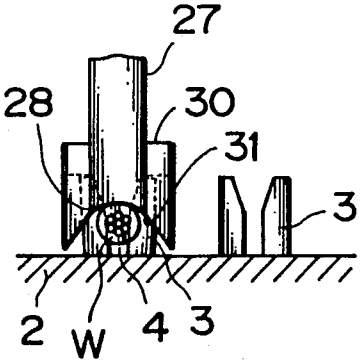
Figure 5C:
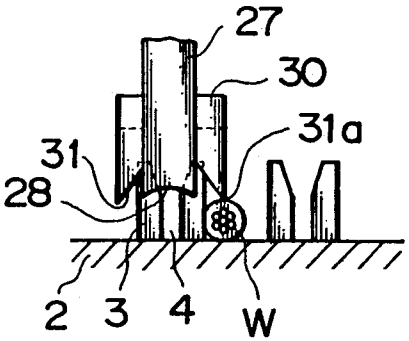

FIG. 1 is a perspective view of an apparatus of this invention. FIG. 2 is an expanded side view of a wire press-installing portion of the apparatus. FIG. 3 is an expanded perspective view of a wire press-installing blade. FIG. 4 is an expanded cross-sectional view of an essential portion of a wire storage device. FIGS. 5A to 5C show the process of press-installing a wire and also a mechanism for detecting a misinstalled wire.

Referring to FIG. 1, reference numeral 10 designates a wire press-installing apparatus and 40 a rated wire storage device. In the wire press-installing apparatus 10, an apparatus body 11 is supported by a stand 12 whose table 13 has a recess 14 formed therein at the center. In the recess 14 is installed a receiver block 15 that securely holds the joint block 1.

Figure 6:
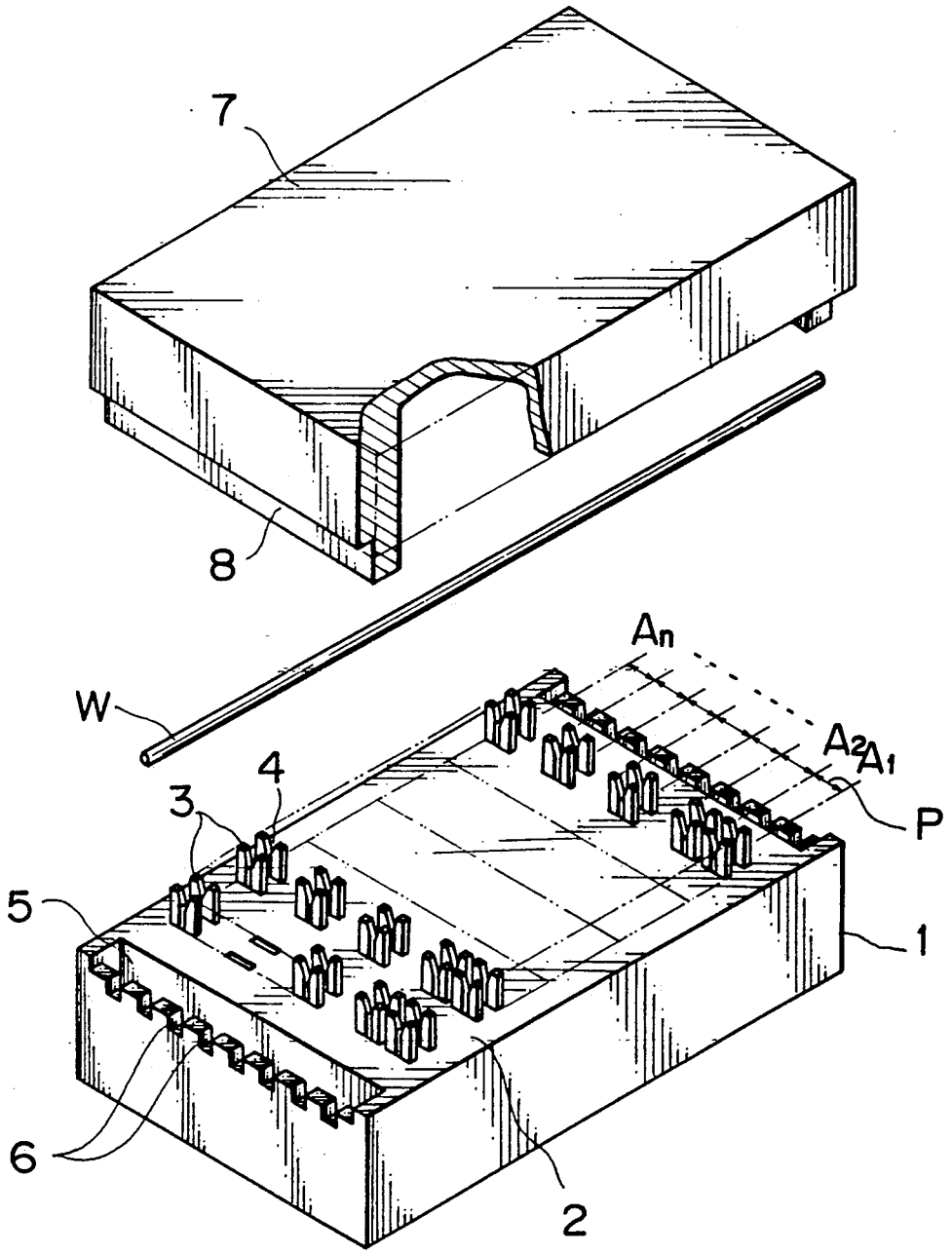
FIG. 6 is a perspective view of a joint block to which this invention is applied.

The receiver block 15, as shown in FIG. 2, is secured to a slide plate 17 which is slidably mounted on a guide groove (not shown) formed in a feed base 16. The slide plate 17 is connected through a connecting rod 18 to a ball nut 19, which is threaded to an intermediate portion of a ball screw 20 that is turned forward and backward by the action of a pulse motor 21. Denoted 22 and 22' are bearing holders that support the ball screw 20. 23 designates a coupling. The receiver block 15 and the joint block 1 mounted thereon are moved in the direction of arrow by the pulse motor 21. By controlling the pulse motor 21, it is possible to intermittently move the joint block 1 a distance equal to the pitch P of the terminal rows (see FIG. 6). On each side of the recess 14, wire axis alignment jigs (clips) 24 with a wire engagement groove 25 are erected on the table 13 so that they are lined in a direction perpendicular to the direction of the joint block movement.

Disposed above the table 13 is a ram 26 which has a wire press-installing blade 27 facing the receiver block 15 and which can be vertically moved relative to the apparatus body 11 by a known mechanism. The wire press-installing blade 27 is shaped like a plate and, as shown in FIGS. 5A to 5C, formed with a curved press surface 28 at the lower end. The wire press-installing blade 27 also has removable wire bending jigs 29 on each lateral end that correspond in position to the recesses 5 of the joint block 1. The wire press-installing blade 27 is provided, at its lower front and rear side, with vertically slidable wire guides 30. While in this embodiment the wire guides 30 are formed as plate members clamping the front and rear sides of the wire press-installing blade 27, they may be in the form of a frame. The lower ends of the wire guides 30, as shown in FIGS. 5A to 5C, are formed into curved guide surfaces 31 that are continuous with the press surface 28 of the wire press-installing blade 27. The lower ends of the wire guides 30 are also formed with a plurality of terminal escape grooves 32 corresponding in position to receiver terminals on the joint block 1. Denoted 33 is a guide pin with its lower end screwed into the wire guide 30. The upper end 33*a* of the guide pin 33 passes through a guide hole 35 in the guide holder 34 secured to one end surface of the wire press-installing blade 27 (or ram 26) and is fitted with a stop spring 36 around the periphery thereof. Coil springs 37 as a resilient member are interposed between the guide holder 34 and the wire press-installing blade 27 to urge the press surface 28 and the guide surface 31 downwardly at all times in such a manner that these surfaces are continuous (FIG. 5A). Designated 38 is a limit switch secured to the guide holder 34 in such a way that its contact lever 38*a* is close to the upper end 33*a* of the guide pin 33. The limit switch 38, in combination with the wire guides 30, forms a mechanism to sense a misinstallation of wire. When the guide pin 33 rises against the resistance of the coil springs 37 and pushes up the contact lever 38*a*, closing the internal contact of the limit switch 38, an alarm circuit (not shown) is activated, which in turn stops the lowering motion of the ram 26 and returns it to the upper position. Designated 39 is a power switch for the apparatus 10, and 39', a start switch for lowering and raising the wire press-installing blade 27.

The wire storage device 40 has a plurality of wire containers 42 mounted on a stand 41. The wire containers 42 are shaped either gutter-like or cylindrical and their number corresponds to the number of terminal rows $A_1, A_2, \ldots, A_n$ on the joint block 1. Each of the wire containers contains the same number of specified rated wires W to be press-installed. Attached to one end of each container 42 through a hinge 43 is a cover 44 that can be opened and closed by two links 45, 46 connected to a cylinder 48 of the solenoid 47, as shown in FIG. 4. A controller 50 mounted on the solenoid cover 49 is connected through signal wire 52 to a signal generator 51 provided to the apparatus body 11. Each time a rated wire W is press-installed on the joint block 1, the signal from the signal generator 51 causes the cover 44 of the specified wire container 42 to be opened, thus allowing only the next rated wire W to be taken out. At the same time, another cover 44 that was opened previously is closed. In the apparatus body 11 is installed a programmed control circuit that controls the operation of the pulse motor 21, ram 26, controller 50, and the signal generator 51.

In FIG. 1, when, with the joint block 1 set on the receiver block 15, the power switch 39 is turned on, the pulse motor 21 (FIG. 2) is energized to move the slide plate 17 forward (or toward the left when viewed in FIG. 2) until the first row $A_1$ (FIG. 6) of the receiver terminals 3 on the joint block 1 is aligned with the wire W stretched between the engagement grooves 25 of the wire axis alignment jigs 24 provided on each side of the slide plate 17.

At this first stop position, the controller 50 is activated by a signal from the signal generator 51 to open the cover 44 of one wire container 42 (left rear in the figure) by the solenoid 47 and the links 45, 46. Then, an operator can pick up, from the wire container 42, a rated wire W to be press-installed into the first row $A_1$ of the receiver terminals.

The rated wire W thus taken out is stretched between and engaged in the wire axis alignment jigs 24, 24 and then placed above the first row $A_1$ of the receiver terminals 3. When the start switch 39' is turned on, the ram 26 is lowered centering the wire W by the press surface 28 of the wire press-installing blade 27, as shown in FIG. 5*b*, and pushing it down until the wire is securely pressed into the slots 4 of the receiver terminals 3. After this, the ram 26 is raised to the original position. When the wire is seated in the terminals, the wire bending jigs 29 attached to both ends of the wire press-installing blade 27 push the ends of the rated wire W into the recesses 5 in the joint block 1. The wire press-installing process described above is disclosed in the Japanese Patent Unexamined Publication No. 58570/1987 and thus its detailed explanation will not be given.

Following the completion of the wire press-installation, the pulse motor 21 is energized to intermittently move the joint block 1 one pitch forwardly. At the same time, the previously opened cover 44 is closed and the cover 44 on the next wire container 42 is opened permitting only the specified rated wire W to be taken out, thus preparing for the next wire press-installing process.

In this way, predetermined rated wires W are taken out from the selected containers and press-installed into successive rows $A_1$, $A_2$, . . . of receiver terminals 3 on the joint block 1.

What has been described above represents the case where a rated wire W is normally pushed into the slots 4 of the receiver terminals 3. When, however, the axis of the rated wire W is located outside the front end portion 31*a* of the guide surface 31 of the wire guide 30, as shown in FIG. 5A, the wire W cannot be guided toward the slot 4 by the guide surface 31. In that case, as the wire press-installing blade 27 is lowered, the front end portion 31*a* of the guide surface 31 abuts against the wire W that has fallen outside on the base 2. Therefore, as shown in FIG. 3, the wire guide 30 moves up against the resistance of the coil springs 37 until the upper end 33*a* of the guide pin 33 pushes the contact lever 38*a* of the microswitch 38, closing the internal contact of the switch 38.

As a result, the buzzer or lamp of the alarm circuit is turned on to alert the operator to the occurrence of a faulty wire press-installation. At the same time the downward movement of the ram 26 is stopped. When this occurs, the operator need only start the wire press-installing process all over again, thus eliminating the possibility of making a faulty product. When a misinstallation of wire occurs, the ram 26 does not comes down to the lowest position, so that no signal is sent from the signal generator to the controller 50, leaving the cover 44 of the next wire container 42 closed.

According to this invention, since the joint block is intermittently moved by a distance equal to the pitch of the receiver terminal rows and only the predetermined rated wires are selectively taken out and press-installed in the associated rows of receiver terminals, there is no possibility of wrong wires being installed in unintended terminals or of the joint block being fed by a wrong pitch, which would result in terminal rows on the joint block being left unseated with wires. As a result, the work efficiency will be significantly improved. Furthermore, the provision of a mechanism for sensing a misinstallation of wire automatically detects a faulty connection in which a part of the receiver terminals fails to have the wire fully seated therein. Thus, faulty products can be eliminated.

While the invention has been particularly shown and described in reference to preferred embodiments thereof, it will be understood by those skilled in the art that cahnges in form and details may be made therein without departing from the spirit and scope of the invention.

What is claimed is:

1. A wire press-installing apparatus for securely seating wires into multiple rows of receiver terminals erected at a predetermined pitch on a base of a joint block, comprising:

a receiver block means for securely holding the joint block thereon;

a table means on which the receiver block means is mounted and means for intermittently moving the receiver block means by a distance equal to the pitch of the receiver terminals on the joint block;

a ram means disposed above the table means and opposite the receiver block means for vertically moving a wire press-installing blade toward and away from the receiver block;

wire axis aligning jig means mounted on the table for temporarily holding the wire such that the wire faces a row of receiver terminals arranged on the base of the joint block;

a plurality of containers, each having a cover and containing specifically rated wires therein; and a means for selecting one of the plurality of containers as having the next wire to be installed in the receiver terminals, said cover being openable in response to a signal from the selecting means and in response to the ram means having moved the distance equal to the pitch of the receiver terminals on the joint block.

* * * * *